United States Patent [19]

Santiago et al.

[11] 4,373,331

[45] Feb. 15, 1983

[54] MANIFOLD ON AN INTERNAL COMBUSTION ENGINE

[75] Inventors: Andres Santiago; Enrique Santiago, both of Diedorf, Fed. Rep. of Germany

[73] Assignee: Zeuna-Staerker GmbH & Co. KG, Fed. Rep. of Germany

[21] Appl. No.: 184,091

[22] Filed: Sep. 4, 1980

[30] Foreign Application Priority Data

Sep. 6, 1979 [DE] Fed. Rep. of Germany ..... 2935926
Nov. 8, 1979 [DE] Fed. Rep. of Germany ..... 2945079

[51] Int. Cl.[3] ..... F01N 7/10
[52] U.S. Cl. ..... 60/323; 60/282
[58] Field of Search ..... 60/282, 323, 322; 123/52 M

[56] References Cited

U.S. PATENT DOCUMENTS

| | | | |
|---|---|---|---|
| 2,940,249 | 6/1960 | Gospodar | 60/323 |
| 3,940,927 | 3/1976 | Maurhoff | 60/323 |
| 4,031,700 | 6/1977 | Yamazaki | 60/323 |
| 4,186,695 | 2/1980 | Gartner | 123/52 M |

FOREIGN PATENT DOCUMENTS

| | | | |
|---|---|---|---|
| 526321 | 6/1931 | Fed. Rep. of Germany . | |
| 1576357 | 3/1970 | Fed. Rep. of Germany . | |
| 1751396 | 8/1970 | Fed. Rep. of Germany . | |
| 2236154 | 4/1974 | Fed. Rep. of Germany . | |
| 2362015 | 6/1975 | Fed. Rep. of Germany . | |
| 2129738 | 11/1975 | Fed. Rep. of Germany . | |
| 2452556 | 5/1976 | Fed. Rep. of Germany | 60/282 |
| 2559149 | 8/1976 | Fed. Rep. of Germany | 60/282 |
| 2535002 | 2/1977 | Fed. Rep. of Germany . | |
| 2558816 | 2/1977 | Fed. Rep. of Germany . | |
| 1286368 | 1/1962 | France | 123/52 M |
| 53-5316 | 1/1978 | Japan | 60/323 |

OTHER PUBLICATIONS

U.S. Steel "Automotive Engineering", Oct., 1979, S. 6, 7.

*Primary Examiner*—Douglas Hart
*Attorney, Agent, or Firm*—Brumbaugh, Graves, Donohue & Raymond

[57] ABSTRACT

An engine exhaust manifold includes two sheet metal half shells welded together to form exhaust passages and adjacent webs for rigidity and absorption of vibrations.

9 Claims, 4 Drawing Figures

1
2
3
5
6
13
16
17
18
19
20
III
III 3
5
6
7
14
15
16
20
21
22
IV 23
24
25

MANIFOLD ON AN INTERNAL COMBUSTION ENGINE

The invention relates to a manifold on an internal combustion engine for the conduction of the exhaust gases between the engine block and the exhaust piping, the manifold comprising pipe lines which are formed by half shells consisting of sheet metal and which are welded together in their common separation plane.

Conventional internal combustion engines have manifolds which are designed as castings and which are very heavy as a result of their great wall thickness. Cast-steel manifolds of this kind are sufficiently heat-resistant and also have a silencing effect on solid-borne vibrations.

Manifolds welded from individual steel pipes have not been successful in the past because of their high production expenditure; for the rest, their special disadvantage lies in the fact that they promote the propagation of sound conducted through solids.

On a known manifold (DE OS No. 15 76 357), there is connected to each cylinder outlet a T-shaped component which is formed by two half shells and comprises an outlet elbow and a pipe length extending transversely thereto. The pipe lengths of several components are laterally connected through flanges. In operation, there is a risk of the pipe lengths becoming warped and the flange connections becoming untight.

The invention has set itself the task of providing a light-weight-construction manifold which not only permanently withstands the high thermal stresses but also has a silencing effect on the propagation of sound conducted through solids.

To solve this problem, the invention proposes that the entire manifold should be composed of two half shells, and that the half shells should form, between the zones forming the pipe lines, one or several flat webs which areally adjoin the separation plane and mutually support one another in the separation plane and are welded together, and that each half shell should be formed by two steel sheets which are moulded together and of which at least the internal one consists of non-scaling steel, and that only in the half shell zones which form the pipe lines there should be provided between the two steel sheets a thin insulating layer consisting of a compressible, heat-resistant material.

A double-shell mode of construction of this kind is occasionally used in the construction of silencers (DE PS No. 526 321), for which, in contrast to manifolds, no special measures are necessary to overcome high thermal stresses.

Due to the fact that the entire manifold is composed of two half shells which are welded together along the edges and in the zone of the webs, there comes about a particularly temperature-stable constructional unit which is rigid to distortion in all directions. The production of the half shells, whose steel sheets are formed, together with the insulating layer, by drawing or stamping or pressing, is simple. The absorption of solid-borne vibration achieved is very effective, the non-existence of an insulating layer in the web zones not being harmful.

Due to the expansion of the insulating layer being restricted to the half shell zones which form the pipe lines, the insulating layer can be formed by a mineral fibre mat cut; the welding-together of the half shells is effected in the zone of the webs which are areally adjacent to the separation plane thereof and which extend between the zones forming the pipe lines. At the same time, this proposal makes possible an economical use of insulating material.

Over and above this, the production can be made cheaper in that only the internal steel sheet of each half shell consists of alloy steel but the external sheet consists of cheap unalloyed steel.

A preferred constructional form provides for each of the half shells to comprise at least two pipe bends which each connect the exhaust-gas ports of two cylinders.

In the case of a four-cylinder in-line engine, it is expedient, with an ignition order of 1, 3, 4, 2 or 1, 2, 4, 3, that, for reasons of output co-ordination, the first and fourth cylinders should be connected through a large pipe bend and the second and third cylinders should be connected through a small pipe bend which is embraced by the large pipe bend. This constructional form also has the smallest space requirement since its dimensions in a direction that is vertical to the plane set up by the pipe bends are only slightly in excess of the diameter of the pipe bends. In accordance with the given constructional factors, the bend pattern of the pipe bends may approximately have the shape of a semi-circle of may differ considerably from this shape, e.g. be unsymmetrical. The proposal of the invention is also suitable for a five-cylinder in-line engine, for which another pipe branching has to be provided on one pipe bend.

An advantageous limitation of thermal stresses is brought about by a development wherein there ends on each pipe bend, in the zone of a half shell, a connection pipe whose free end is connected to a flange part for the connection of the exhaust piping. A connection pipe of this kind absorbs thermal expansions by way of deformation.

The invention will be explained hereinafter by the example of a manifold for a four-cylinder in-line engine with reference to the drawings, in which.

Figure 1:
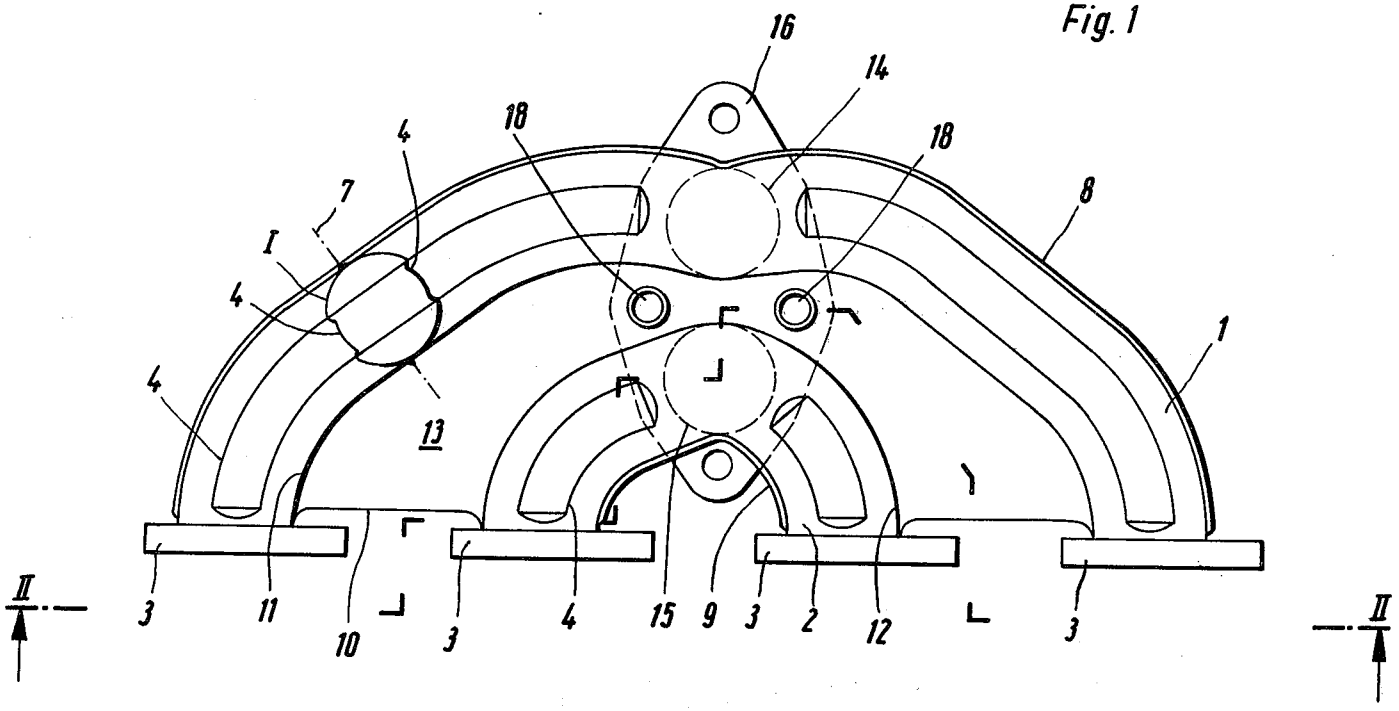
FIG. 1 shows a top view of the manifold.

Considered in the top view of FIG. 1, the manifold composed of two half shells comprises an external pipe bend 1 and an internal pipe bend 2, the external pipe bend 1 embracing the internal pipe bend 2. At their open ends, the pipe bends 1, 2 are provided with flanges 3 which are screwed to the outsides of the cylinder heads of a four-cylinder in-line engine (not shown) in a sealing manner above the exhaust-gas ports of the associated cylinders. The cross-sectional representation I rotated into the drawing plane (FIG. 1) shows that the half shells of the gas-carrying pipe bends have wide beads so as to increase their stability. The two half shells 5, 6 (see FIG. 2) are welded together in the separation plane 7 along their circumferential edges, namely on the outside at 8, on the inside at 9 and between the pipe bends at 10, but also along the edges 11, 12 of the web 13 provided between the pipe bends. Additional welding spots may be provided in the interior of the surface of the web 13. The two pipe bends 1, 2 are connected through connection collars 14, 15 to exhaust pipe (FIG.

3) which is connected to a flange 16 that is common to both pipe sockets.

Figure 2:
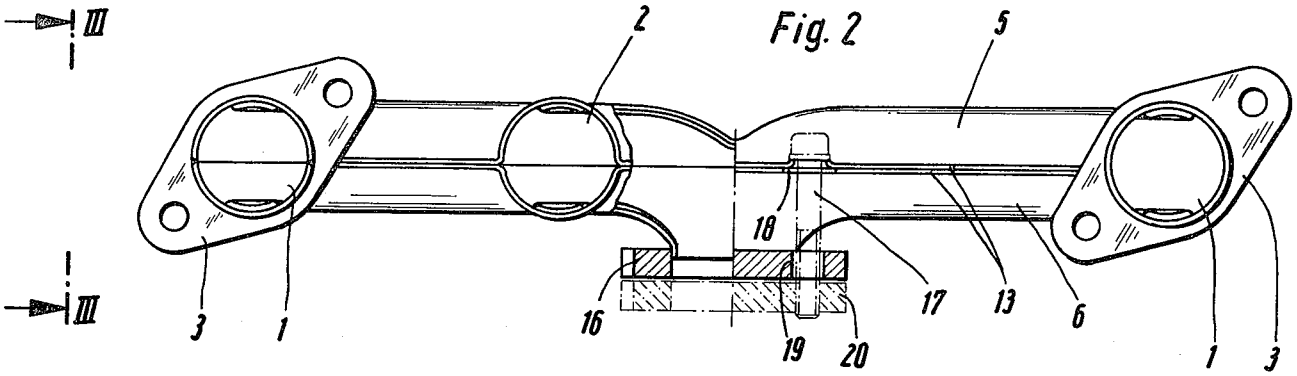
FIG. 2 shows a side view of the manifold shown in FIG. 1, partly sectioned according to the sectional disposition II—II.

The sectional representation of FIG. 2 shows as an additional fastening point a screw 17 which is passed through an opening 18 in the web 13 as well as through a bore 19 in the flange 16 and has been screwed into an exhaust piping flange 20 which is indicated in dash-dotted lines. As shown in FIG. 1, there are provided in the zone of the web 13 two openings 18 for screws for the vibration-free installation of the manifold.

Figure 3:
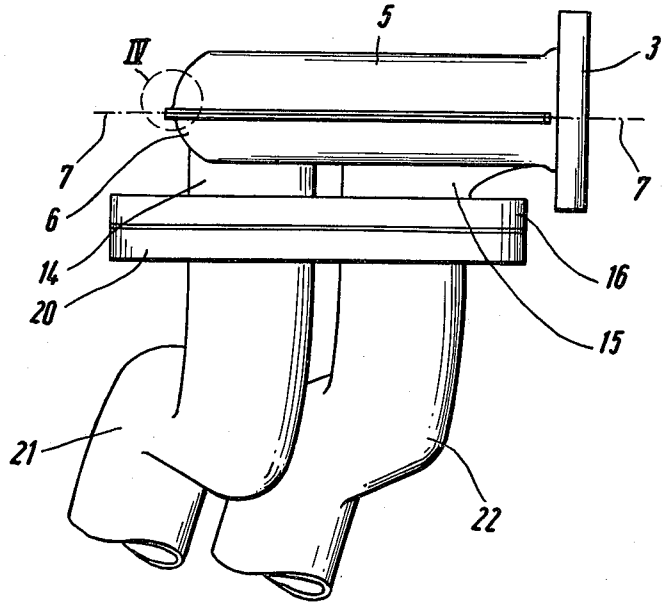
FIG. 3 shows a side view of the manifold according to III—III of FIG. 2.

The side view shown in FIG. 3 depicts two exhaust pipes 21, 22 which are secured to the flange 16 on the underside of the manifold by means of their common flange 20 through a screw connection not shown.

Figure 4:
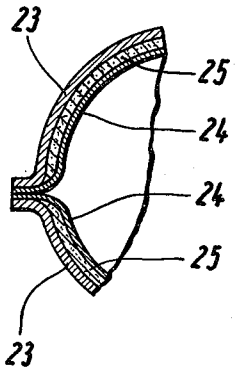
FIG. 4 shows an enlarged wall cut-out according to IV of FIG. 3.

The wall cut-out shown in FIG. 4 illustrates the composition of the half shells of respectively one external steel sheet 23, which preferably has good high-temperature characteristics and has a thickness of approximately 1.5 mm, and an internal, preferably non-scaling steel sheet 24 having a thickness of approximately 0.5 mm. Between these sheets, but outside their circumferential edges 8, there has been pressed in an insulating layer 25 consisting of ceramic fibers, e.g. based on aluminium silicate, the insulating layer being compressed from approximately 6 mm to 2 mm during the forming of the steel sheets.

We claim:

1. A manifold for an internal combustion engine for conducting exhaust gases from the engine to exhaust piping, said manifold comprising:

two half shells;

each half shell shaped such that when welded to the other half shell pipe lines are defined which lead from each exhaust gas port of the engine, and at least one flat web is defined between said pipe lines;

each half shell comprising two steel sheets overlaying one another, at least the sheet to be positioned adjacent the other half shell being comprised of non-scaling steel, and a thin insulating layer of a compressible, heat resistant material between said sheets only in the areas where said pipe lines are to be defined;

said half shells and said two steel sheets of each half shell all being welded together along the edges of the pipe lines and at a plurality of points in said web;

said pipe lines thereby being comprised of an upper wall portion defined by one half shell and a lower wall portion defined by the other half shell, said web thereby being comprised of flat portions of both half shells welded together at least at their respective edges where said pipes are defined and mutually supporting one another.

2. A manifold according to claim 1 wherein the half shells define at least two pipes, the respective ends of each pipe communicating with the exhaust ports of at least cylinders.

3. A manifold according to claim 2 wherein each pipe has an opening intermediate the ends of the pipe, said opening comprising a connection pipe for communication with exhaust piping.

4. A manifold according to claim 3 wherein said opening is in one half shell only.

5. A manifold according to claim 3 intended for use in a four cylinder engine wherein a first pipe communicates with the exhaust ports of the first and fourth cylinders of the engine and the second pipe communicates with the exhaust ports of the second and third cylinders of the engine.

6. A manifold according to claim 5 wherein each pipe has a connection pipe which is connected to a common flange for attachment to exhaust piping.

7. A manifold according to claim 6 wherein said first pipe is located further from the engine than said second pipe.

8. A manifold according to claim 1 wherein the steel sheet of each half shell to be positioned adjacent the other half shell comprises alloy steel and the other steel sheet comprises unalloyed steel.

9. A manifold according to claim 8 wherein said insulating layer of each half shell comprises a mineral fibre mat cut to correspond to the shape of the pipes, said mat being positioned between the steel sheets prior to the deformation of the sheets to form said half shell.

* * * * *